US009044961B2

(12) United States Patent
Ridwan

(10) Patent No.: US 9,044,961 B2
(45) Date of Patent: Jun. 2, 2015

(54) DOT MATRIX PRINTER FOR PASSBOOKS OR RECEIPTS

(75) Inventor: Liow Ridwan, Singapore (SG)

(73) Assignee: Wincor Nixdorf International GmbH (DE)

( * ) Notice: Subject to any disclaimer, the term of this patent is extended or adjusted under 35 U.S.C. 154(b) by 473 days.

(21) Appl. No.: 13/466,645

(22) Filed: May 8, 2012

(65) Prior Publication Data

US 2012/0288313 A1 Nov. 15, 2012

(30) Foreign Application Priority Data

May 9, 2011 (EP) ..... 11165303

(51) Int. Cl.

| | |
|---|---|
| ***B41J 2/22*** | (2006.01) |
| ***B41J 3/28*** | (2006.01) |
| ***B41J 2/23*** | (2006.01) |
| ***B41J 29/02*** | (2006.01) |
| ***B41J 29/10*** | (2006.01) |

(52) U.S. Cl.

CPC .. *B41J 3/283* (2013.01); *B41J 2/23* (2013.01); *B41J 29/02* (2013.01); *B41J 29/10* (2013.01)

(58) Field of Classification Search

CPC ..... B41J 2/22; B41J 1/18; B41J 2/30; B41J 11/0045; B41J 13/00; B41J 9/00

USPC ..... 400/124.11, 124.12, 124.24, 124.27, 400/124.32, 124.01–124.05

See application file for complete search history.

(56) References Cited

U.S. PATENT DOCUMENTS

| | | | | | |
|---|---|---|---|---|---|
| 4,466,753 | A | * | 8/1984 | Willcox | 400/354 |
| 5,158,378 | A | * | 10/1992 | Takada et al. | 400/124.01 |
| 5,240,336 | A | * | 8/1993 | Shiraishi et al. | 400/693 |
| 5,244,295 | A | * | 9/1993 | Terashima et al. | 400/639 |
| 5,399,039 | A | * | 3/1995 | Giles et al. | 400/636 |
| 5,401,540 | A | * | 3/1995 | Miles et al. | 427/256 |
| 5,406,321 | A | * | 4/1995 | Schwiebert et al. | 347/102 |
| 5,479,199 | A | * | 12/1995 | Moore et al. | 347/102 |
| 5,500,667 | A | * | 3/1996 | Schwiebert et al. | 347/102 |
| 5,633,668 | A | * | 5/1997 | Schwiebert et al. | 347/102 |
| 5,676,474 | A | * | 10/1997 | Doi | 400/124.04 |
| 5,707,161 | A | * | 1/1998 | Pessina | 400/616.2 |
| 5,713,674 | A | | 2/1998 | Nakayama et al. | |
| 6,899,296 | B2 | * | 5/2005 | Kansaku et al. | 242/555.5 |
| 7,252,233 | B2 | * | 8/2007 | Takiguchi | 235/454 |
| 2006/0210345 | A1 | | 9/2006 | Sanada et al. | |

FOREIGN PATENT DOCUMENTS

| | | |
|---|---|---|
| DE | GB 2 213 106 | 8/1989 |
| JP | 64-078870 | 3/1989 |
| JP | 2001-347725 | 12/2001 |

* cited by examiner

*Primary Examiner* — David Banh

(74) *Attorney, Agent, or Firm* — Harness, Dickey & Pierce, P.L.C.

(57) ABSTRACT

The invention relates to a dot matrix printer (10) which comprises a printing unit (12) for printing a printing material and a feed area (20) for feeding the printing material to the printing unit (12). In the feed area (20) a gap (26) is formed through which the printing material is transported. In a print mode, the printing unit (12) prints the printing material, whereas in a feed mode the printing material can be fed from the feed area (20) to the printing unit (12) and the printing material is not printed. Further, the dot matrix printer (10) comprises a closing unit (32) which at least partially closes the gap (26) in the print mode.

12 Claims, 4 Drawing Sheets

DOT MATRIX PRINTER FOR PASSBOOKS OR RECEIPTS

CROSS REFERENCE TO RELATED APPLICATION

This application claims priority to European patent application 11 165 303.6 filed May 9, 2011, which is hereby incorporated by reference.

BACKGROUND OF THE INVENTION

1. Technical Field

The invention relates to a dot matrix printer comprising a printing unit for printing a printing material to be printed and a feed area for feeding the printing material to the printing unit. In the feed area, a gap is formed through which the printing material to be fed is transported. In a print mode, the printing unit prints the printing material, whereas in a feed mode the printing material can be fed from the feed area to the printing unit and the printing material is not printed. The dot matrix printer is used in particular in banks for printing saving account passbooks and in forwarding agencies for printing receipts.

2. Discussion

Known dot matrix printers for printing passbooks and receipts have an input unit via which the passbooks or receipts are manually fed into a feed area. This feed area is limited by two limiting elements between which a gap is formed. The passbooks or receipts are transported through this gap and are fed to the printing unit. During printing of the passbooks or receipts, significant noise inevitably occurs when using a dot matrix printer. Therefore, in the case of the known dot matrix printers the housing of the dot matrix printer is insulated accordingly to keep the noise pollution for the operator as low as possible. What is problematic with the known dot matrix printers is, however, that noise can still escape to a considerable extent through the input opening, which can make the handling of the dot matrix printer annoying for the operator.

SUMMARY OF THE INVENTION

It is the object of the invention to specify a dot matrix printer which has a low noise emission.

By providing a closing unit which at least partially closes the gap in the print mode, the printing unit is shielded from the operator so that the noise escaping from the dot matrix printer is reduced and thus the noise pollution for the operator is minimized. Therefore, the handling of the dot matrix printer is much more pleasant for the operator.

The printing materials to be printed are in particular saving account passbooks and/or receipts. When printing with a dot matrix printer, carbon copies can likewise be printed in a printing process. The feed area in particular comprises a first limiting element on which the printing material rests and a second limiting element opposite to the first limiting element, the gap being formed between these two limiting elements.

Preferably, the closing unit is arranged in a closed position in the print mode and in an open position in the feed mode. In a particularly preferred embodiment of the invention, the closing unit completely closes the gap in the closed position so that the noise pollution for the operator of the dot matrix printer is minimized. In an alternative embodiment of the invention, the closing unit may only partially close the gap in the closed position.

The closing unit is preferably arranged outside the gap in the open position and at least partially within the gap in the closed position. Thus, the closing unit does not impede the feeding of the printing material in the open position, i.e. in the feed mode, yet it still reduces the noise escaping in the print mode.

Between its open and closed position, the closing unit is in particular moved in translation or on a circular path. For this, at least one movement vector of the direction of movement is arranged orthogonally to the feed direction of the printing material and/or orthogonally to the limiting elements that delimit the gap. The second limiting element in particular has a recess, within which the closing unit is at least partially received in its open position.

In an alternative embodiment of the invention, the closing unit can also comprise a shutter which is rotatably mounted about an axis of rotation and is rotated in the open position by a preset angle about this axis of rotation relative to the closed position. In this way, an easy and space-saving structure of the closing unit is achieved.

The closing unit preferably has a deformable element, which, in the closed position and when a printing material is arranged in the gap, contacts this printing material so that the remaining gap is completely or at least almost completely closed and the printing material can still be transported further in the direction of the printing unit. Thus, in the print mode, the remaining gap is closed and the emission of noise is reduced, and the printing material, which is in part still arranged within the feed area, can nevertheless be transported further to the printing unit. The deformable element completely closes the gap when no printing material is arranged in the gap so that in this case noise cannot escape. By way of the deformable element it is in particular guaranteed that, independent of the thickness of the printing material arranged in the gap and/or independent of whether printing material is arranged in the gap at all, the gap is closed at least almost completely.

The deformable element is, for example, formed of foam material, and the thicker the printing material in the gap, the more this foam material is compressed. Alternatively, the deformable element can also be formed in a brush-like manner.

The printing unit in particular comprises a print head and a counter-pressure element between which the printing material is transported during printing. Here, the printing material is pressed against the counter-pressure element by the needles of the print head during printing so that the required counter-pressure is generated. Further, the printing unit has a drive unit for moving the counter-pressure element, the counter-pressure element being arranged in the print mode in a printing position in which the counter-pressure element has a first distance to the print head, and the counter-pressure element being arranged in the feed mode in a feeding position in which the counter-pressure element has a second distance to the print head. Here, the second distance is greater than the first distance. Thus, in the feed mode, the printing material can be fed to the printing unit without being impeded by the counter-pressure element. In the print mode, on the other hand, the printing material is pressed against the print head by the counter-pressure element so that high-quality printing is made possible.

In a preferred embodiment of the invention, the closing unit can be moved from the closed position into the open position and/or from the open position into the closed position with the aid of this drive unit for moving the counter-pressure element. Thus, no separate drive unit for moving the closing unit has to be provided so that a simple and cost-efficient structure is achieved.

For this, the closing unit is in particular mechanically coupled to the counter-pressure element via a coupling mechanism so that the closing unit is automatically moved from the closed position into the open position when the counter-pressure element is moved from the printing position into the feeding position, and/or is automatically moved from the open position into the closed position when the counter-pressure element is moved from the feeding position into the printing position. What is meant by "automatically moving" is in particular that the movement of the closing unit takes place inevitably, for example, when moving the counter-pressure element. In this way it is guaranteed that the closing unit is actually arranged in the closed position in the print mode and in the open position in the feed mode. Further, a simple and compact structure is achieved hereby.

For printing the printing material in particular transversely to the feed direction of the printing material, the print head is moved with the aid of a further drive unit so that the printing material can be printed over its entire width with the aid of the print head. In the feed mode the print head is arranged in a resting position, and in the print mode it is arranged outside this resting position. Instead of being coupled to the counter-pressure element, the closing unit can also be coupled via a coupling mechanism to the print head. When moving the print head out of the resting position, this coupling mechanism automatically moves the closing unit from the open position into the closed position and/or when moving the print head into the resting position, it automatically moves the closing unit from the closed position into the open position. By way of this embodiment, too, it is guaranteed that, via the coupling mechanism, the closing unit is inevitably arranged in the open position when the printer is operated in the feed mode and in the closed position when the printer is operated in the print mode.

The print head is in particular fixedly mounted on a carrier unit, this carrier unit being moved together with the print head for moving the print head transversely to the feed direction by the further drive unit. The coupling mechanism is in particular connected to this carrier unit so that the closing unit is automatically moved between the closed and the open position when the carrier unit is moved.

Further, it is advantageous when the closing unit is held in the closed position or in the open position with the aid of an elastic element, and may only be moved into the respective other position against a restoring force of the elastic element by means of the coupling mechanism. In particular, the elastic element is formed in the form of a spring.

In the feed area, at least one transport element is arranged for transporting the printing materials in feed direction so that it is guaranteed that the printing material can be reliably fed to the printing unit. In particular, several pairs of rolls are provided as transport elements, at least one roll of each pair of rolls being driven such that a printing material contacting this roll is transported in feed direction. The other roll of the pair of rolls serves as a counter-pressure roll. The transport elements are in particular arranged between the closing unit and the printing unit.

Upstream of the feed area, there is in particular provided an input unit via which the printing material can be manually input into the dot matrix printer. The input unit in particular has an opening and a support element, the printing material, while resting on this support element, being fed through this opening to the dot matrix printer by the operator.

The gap is preferably dimensioned such that a passbook can be transported therethrough as a printing material. Thus, with the aid of the dot matrix printer a passbook and/or a bundle of receipts, in particular a receipt along with corresponding carbon copies can be printed.

Further features and advantages of the invention result from the following description which explains the invention in more detail with reference to embodiments in connection with the enclosed figures.

DESCRIPTION OF THE PREFERRED EMBODIMENTS OF THE INVENTION

Figure 1:
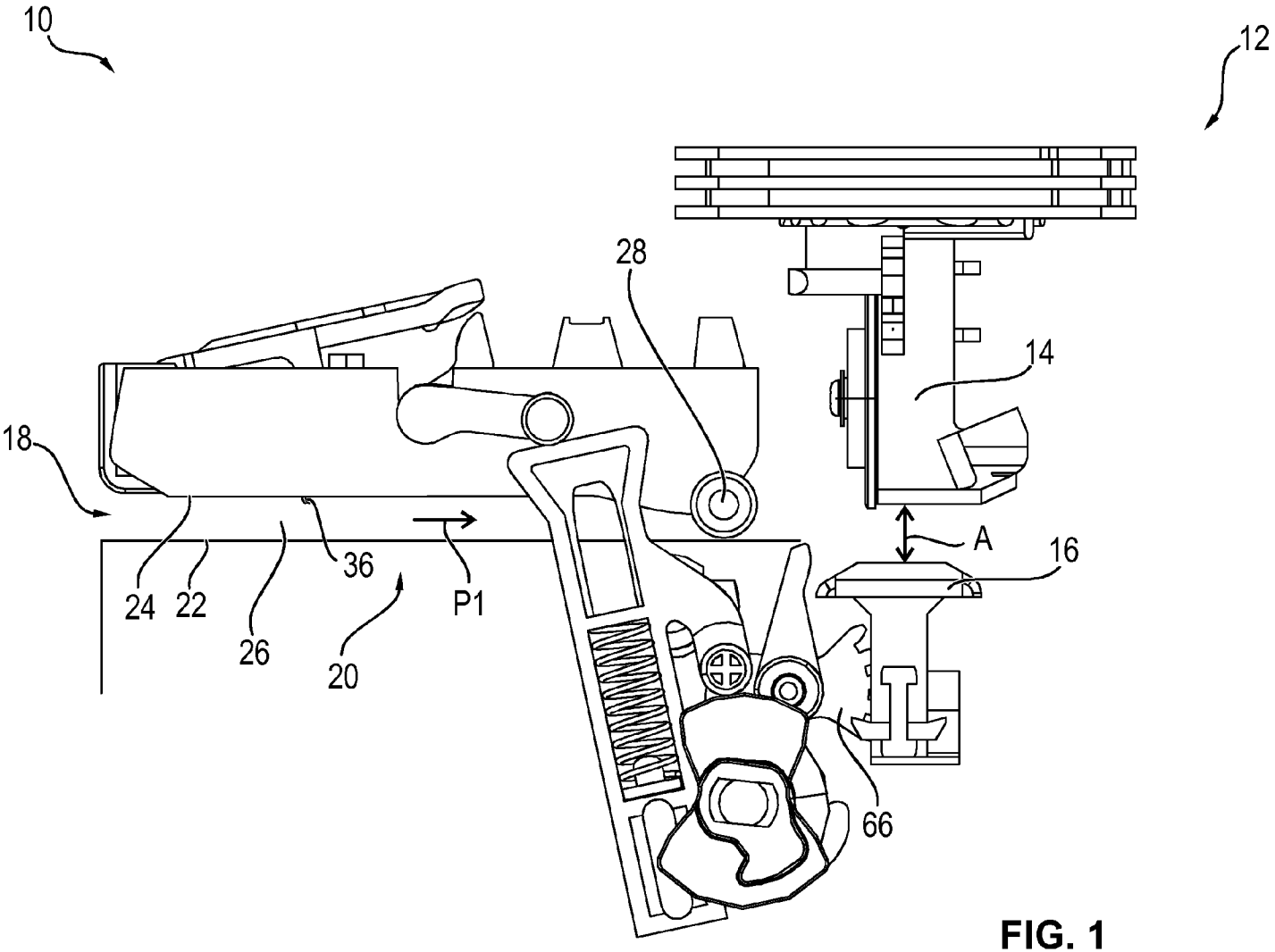
FIG. 1 shows a schematic illustration of a dot matrix printer in a feed mode.

In FIG. 1, a schematic illustration of a detail of a dot matrix printer 10 is shown in a feed mode. The dot matrix printer 10 serves in particular to print passbook entries and/or to print receipts, the dot matrix printer 10 comprising a printing unit 12 for printing, said unit having a print head 14 and a counter-pressure element 16.

Further, the dot matrix printer 10 has an input opening 18 via which the printing material, i.e. in particular a passbook and/or receipts, can be manually fed to a feed area 20 of the dot matrix printer 10. The feed area 20 comprises two limiting elements 22, 24, which are arranged at a predetermined distance to each other so that a gap 26 is formed between them. The fed printing material rests on the first limiting element 22 and is fed in the direction of the arrow P1 in a feed direction to the printing unit 12. The dot matrix printer 10 in particular comprises several driven rolls 28 which contact the printing material to be printed when it is arranged in the feed area 20 and transport it in the feed direction P1 to the printing unit 12.

In the feed mode illustrated in FIG. 1, the counter-pressure element 16 is arranged at a predetermined distance A to the print head 14 so that the printing material can be arranged between the counter-pressure element 16 and the print head 14.

Figure 2:
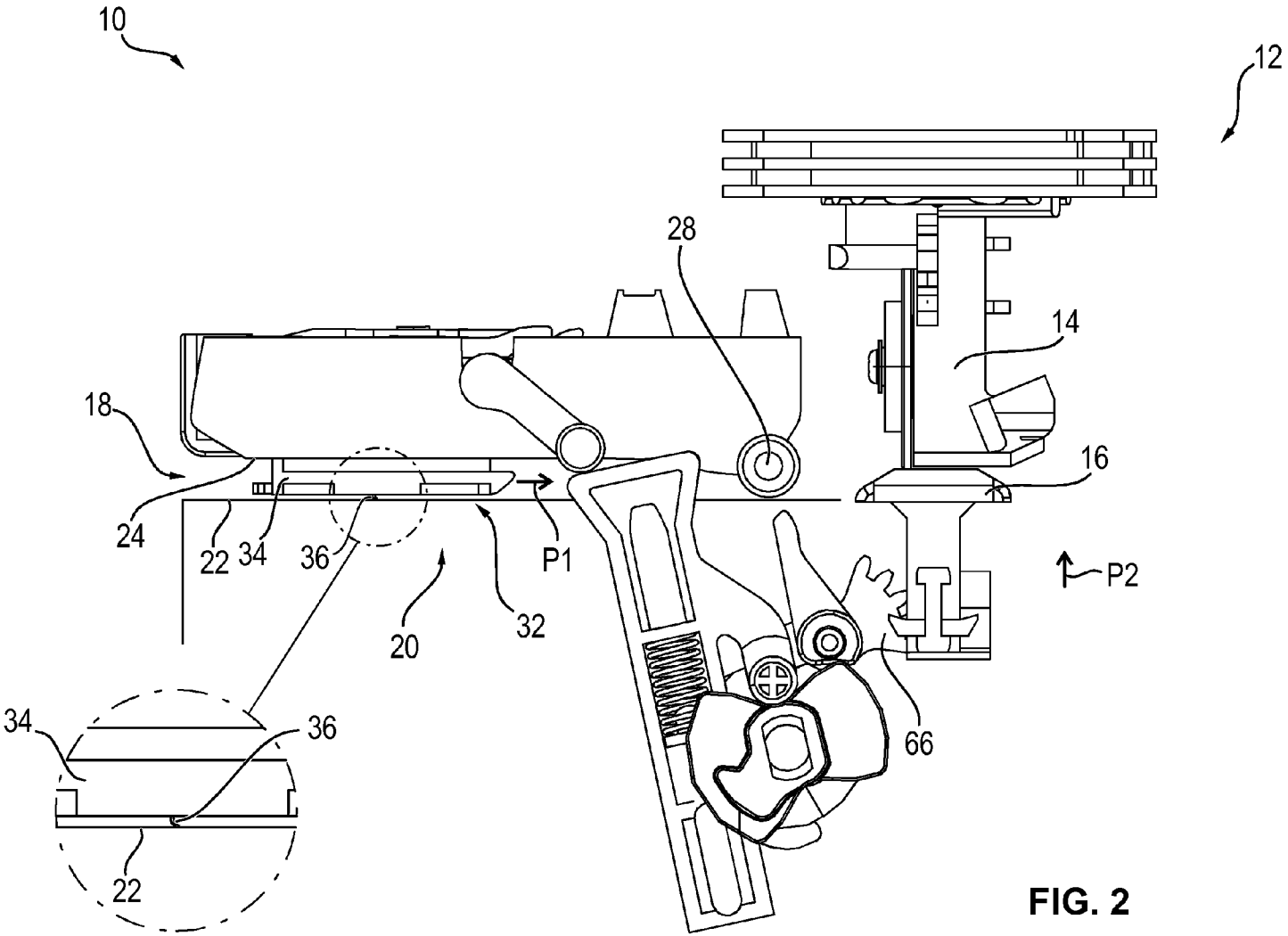
FIG. 2 shows a schematic illustration of a dot matrix printer according to FIG. 1 in a print mode.

In FIG. 2, a schematic perspective illustration of the dot matrix printer 10 is illustrated in a print mode. In this print mode, the counter-pressure element 16 is moved in the direction of the arrow P2 toward the print head 14 by means of a drive unit 30 (FIG. 3) so that the counter-pressure element 16 presses a non-illustrated printing material against the print head 14 and the printing material can be reliably printed by the print head 14. The counter-pressure element 16 is arranged in a printing position in the print mode and in a feeding position in the feed mode.

The dot matrix printer 10 comprises a closing unit 32 which closes the gap 26 in the print mode so that noise generated by the printing unit 14 during printing of the printing material cannot escape through the input opening so that the noise pollution for the operator of the dot matrix printer 10 is minimized. When the dot matrix printer 10 is operated in the print mode, the closing unit 32 is arranged in a closed position illustrated in FIG. 2, in which it completely closes the gap 26. In an alternative embodiment, the closing unit 32 can also only partially close the gap 26 in the closed position.

In the feed mode illustrated in FIG. 1, the closing unit 32 is arranged outside the gap 26 in an open position so that the printing material can be fed to the printing unit 12 unimpededly through the gap 26. For this, the closing unit 32 is in particular at least partially received in a recess of the second limiting element 24. In an alternative embodiment of the invention, the closing unit 32 may also be arranged not completely outside the gap 26 in the open position, but still project a little into the gap 26. The closing unit 32 projects less into the gap 26 in the open position than in the closed position and projects into the gap 26 in the open position only so far that a feeding of the printing material through the remaining gap 26 is not impeded.

The closing unit 32 comprises a rigid element 34 and a brush-like deformable element 36, a part of the gap 26 being closed by the rigid element 34 and the remaining part of the gap 26 being closed by the brush-like deformable element 36 when the closing unit 32 is in the closed position. Here, the brushes of the brush-like element 36 contact the first limiting element 22 so that the gap 26 is easily closed. In the operating mode illustrated in FIG. 2, printing material is no longer arranged in the gap 26. Depending on the length of the printing material and/or depending on how much of the printing material has already been printed by the printing unit 12, it may, however, also be the case that a part of the printing material is still arranged within the gap 26 in the print mode. By way of the brush-like deformable element 36 which, in this case, rests on the side of the printing material facing away from the first limiting element 22 it is achieved that the printing material can be transported further in the feed direction P1 of the printing unit 12, while the gap 26 is still closed.

In an alternative embodiment of the invention, instead of being formed like a brush, the deformable element 36 may also be formed of foam material that can be deformed such that it closes the gap remaining between the rigid element 34 and a printing material that might be arranged in the gap 26. Further, in the alternative, the closing unit 32 may be designed such that the gap 26 is exclusively closed by a deformable element 36 in the closed position. Alternatively, it is likewise possible that the closing unit 32 only comprises a rigid element 34.

The closing unit 32 may be moved in translation between the open position and the closed position, or vice versa, or may be pivoted about an axis of rotation. Alternatively, it is likewise possible that the closing unit 32 performs a motion that is composed of a translatory motion and a rotary motion when moving between the closed and the open position, or vice versa.

Figure 3:
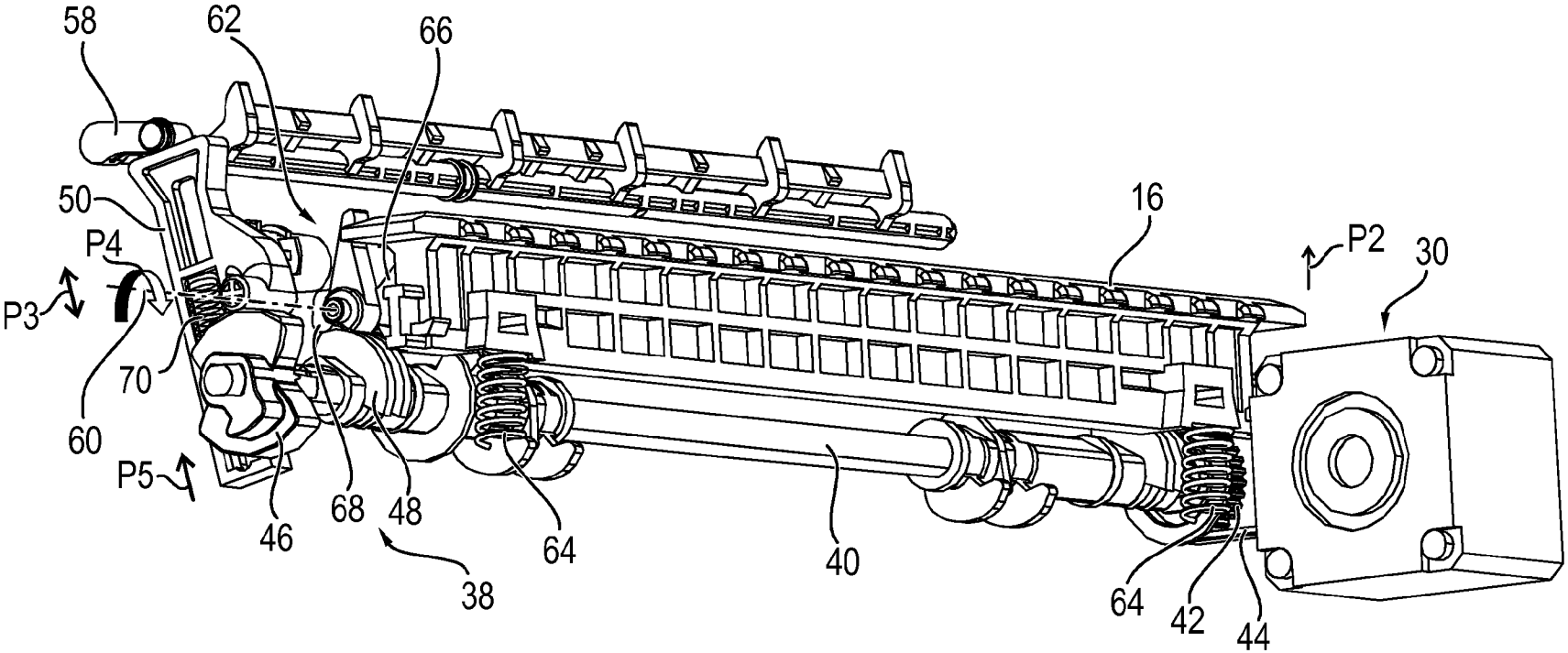
FIG. 3 shows a schematic illustration of a coupling mechanism for coupling a closing unit to a counter-pressure element.

The closing unit 32 is connected to the counter-pressure element 16 via a coupling mechanism shown in an isolated manner in FIG. 3. The closing unit 32 comprises a shaft 40 which is connected to the drive unit 30 via a gearwheel 42 and a belt 44 and can be rotated about its longitudinal axis by means of this drive unit. On the shaft 40, two cam disks 46 and 48 are mounted in a rotationally fixed manner, the first cam disk 46 contacting a connecting element 50 which is mounted such that it can be moved in the direction of the double arrow P3 and which, with its side facing away from the first cam disk 46, in turn contacts a lever 58 for moving the closing unit 32 between the open and the closed position. Further, the coupling mechanism 38 comprises a shifting element 62 rotatably mounted about an axis of rotation 60, said shifting element 62 comprising a toothed segment 66. The toothed segment 66 engages with a non-visible toothing of the counter-pressure element 16.

The counter-pressure element 16 is held in the printing position by two springs 64. In the print mode illustrated in FIG. 2, the shaft 40 is rotated such that the second cam disk 48 does not contact a cam 68 of the shifting element 62 and that the connecting element 50 is not moved in the direction of the lever 58 by the first cam disk 46 so that the closing unit 32 is arranged in the closed position.

For changing the dot matrix printer 10 from the print mode to the feed mode, the shaft 40 is rotated by the drive unit 30 such that the cam disk 48 contacts the cam 68 of the shifting element 62 and lifts it so that the shifting element 62 is rotated in the direction of the arrow P4. The counter-pressure element 16 is thus lowered opposite to the direction of the arrow P2 by the engagement of the toothed segment 66 with the toothing of the counter-pressure element 16 and thus moved from the printing position into the feeding position.

By the rotation of the shaft 40, the first cam disk 46 is likewise rotated so that it lifts the connecting element 50 and moves it against the spring force of a spring 70 in the direction of the arrow P5. Thus, the lever 58 is lifted by the connecting element 50 so that the closing unit 32 moves from the closed position into the open position. For this, the closing unit 32 can in particular be held in the open position via springs.

For closing the closing unit 32, the shaft 40 is again rotated such that the cam disk 46 no longer lifts the connecting element 50 and the second cam disk 48 no longer contacts the shifting element 62 so that the shifting element 62 is again moved into the printing position by the springs 64. Further, the connecting element 50 is again moved opposite to the arrow P5 by the spring 70.

Via the coupling mechanism 68 it is achieved that, when shifting between the feed mode and the print mode of the dot matrix printer 10, the closing unit 32 is automatically switched between the open and the closed position. Thus, it is not required to provide an additional drive unit for moving the closing unit 32. Further, such a drive unit need not be controlled in a complex manner either to ensure that the gap 26 is actually closed when the printing unit 10 is operated in the print mode.

Figure 4:
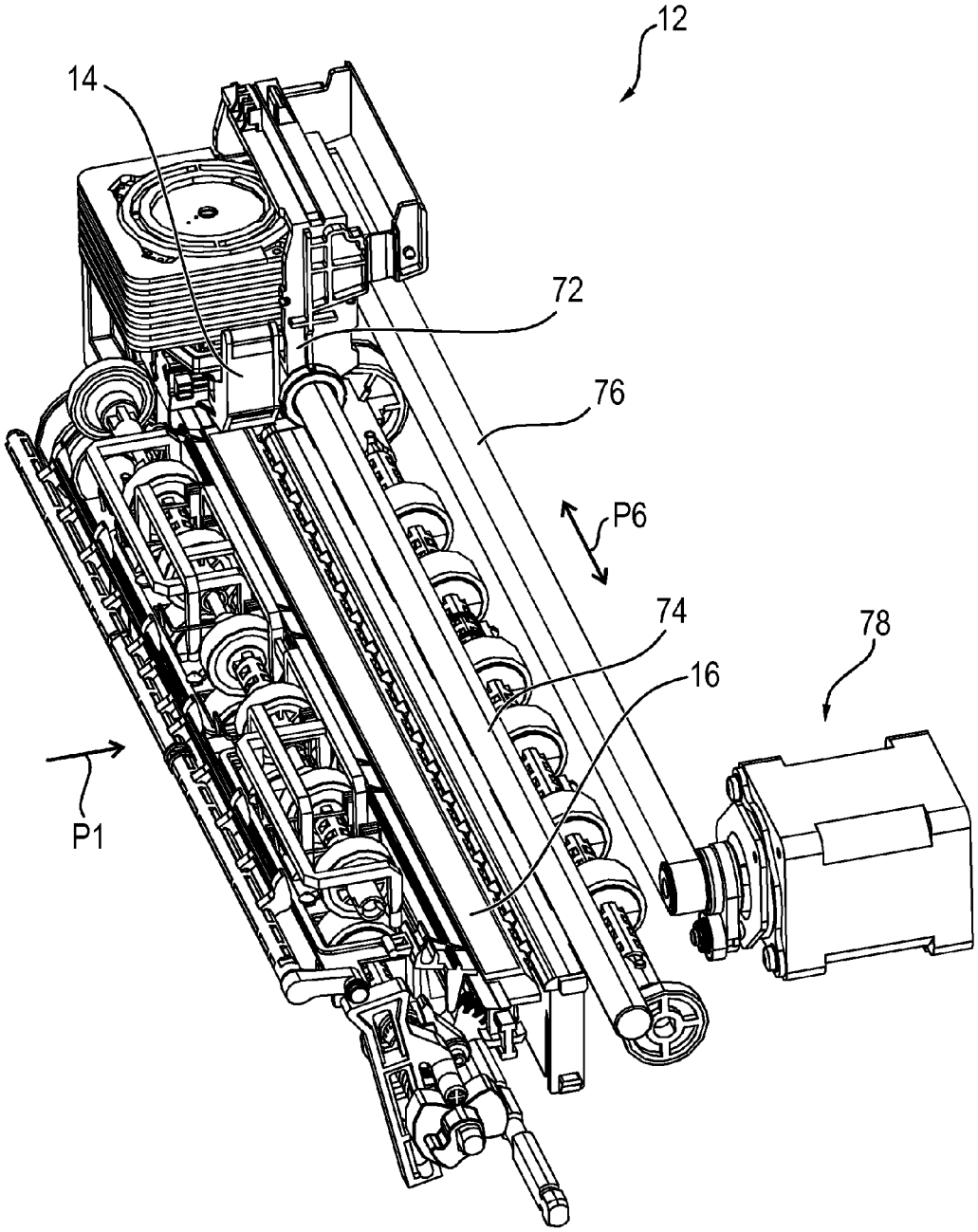
FIG. 4 shows a schematic perspective illustration of a printing unit of the dot matrix printer according to FIGS. 1 to 3.

In FIG. 4, a schematic perspective illustration of the printing unit 12 is illustrated. The print head 14 is mounted on a carrier 72 which in turn is mounted such that it can be moved on a rod 74 in the direction of the arrow P6. The carrier 72 is connected via a belt 76 to a further drive unit 78 by which the carrier 72, and thus the print head 14, can be moved in the direction of the double arrow P6 over the width of the printing material for printing.

In an alternative embodiment of the invention, the closing unit 32 can also be coupled to the carrier 72 instead of to the counter-pressure element 16 to provide a correspondingly designed coupling mechanism. When the dot matrix printer 10 is operated in the feed mode, the print head 14 and thus also the carrier 72 are arranged in a resting position. For printing the printing material, the print head 14 is moved out of this resting position by the drive unit 78. The coupling mechanism for coupling the closing unit 32 and the carrier 72 is designed such that the closing unit 32 is arranged in the open position when the carrier 72 is arranged in the resting position and is moved into the closed position when the carrier 72 is moved out of the resting position. In contrast thereto, the closing unit 32 is again moved into the open position when the carrier 72 is moved into the resting position.

In a further alternative embodiment of the invention, the closing unit 32 may not be coupled to any of the units of the printing unit 12 via a coupling mechanism but may be moved from the closed position into the open position and/or from the open position into the closed position via a separate drive unit.

The invention claimed is:

1. A dot matrix printer comprising:

a printing unit for printing a printing material to be printed, a feed area for feeding the printing material to the printing unit, wherein the feed area comprises a gap through which the printing material to be fed is transported, the printing unit prints the printing material in a print mode, wherein, in a feed mode, the printing material can be fed from the feed area to the printing unit and the printing unit does not print the printing material, a closing unit which at least partially closes the gap in the print mode, wherein the closing unit is arranged in a closed position in the print mode and in an open position in the feed mode; and wherein the printing unit comprises a print head and a counter-pressure element, between which the printing material is transported during printing, in that a drive unit for moving the counter-pressure element is provided, in that the counter-pressure element is arranged in the print mode in a printing position in which the counter-pressure element has a first distance to the print head, in that the counter-pressure element is arranged in the feed mode in a feeding position in which the counter-pressure element has a second distance to the print head, the second distance being greater than the first distance, and in that the closing unit is moved from the closed position into the open position and/or from the open position into the closed position with the aid of the drive unit.

2. The dot matrix printer according to claim 1, wherein the closing unit is arranged outside the gap in the open position, and at least partially within the gap in the closed position.

3. The dot matrix printer according to claim 2, wherein the closing unit comprises a shutter, in that the shutter is rotatably mounted about an axis of rotation, and in that the shutter is rotated in the open position by a preset angle about this axis of rotation relative to the closed position.

4. The dot matrix printer according to claim 2 wherein the closing unit comprises a deformable element, in that the deformable element, in the closed position and when a printing material is arranged in the gap, contacts this printing material so that the remaining gap is completely closed and the printing material can be transported further in the direction of the printing unit, and in that the deformable element completely closes the gap in the closed position when no printing material is arranged in the gap.

5. The dot matrix printer according to claim 4, wherein the deformable element is formed of foam material or in a brush-like manner.

6. The dot matrix printer according to claim 1, wherein the closing unit is mechanically coupled to the counter-pressure element via a coupling mechanism so that the closing unit is automatically moved from the closed position into the open position when the counter-pressure element is moved from the printing position into the feeding position and/or is automatically moved from the open position into the closed position when the counter-pressure element is moved from the feeding position into the printing position.

7. The dot matrix printer according to claim 1 wherein the closing unit is held in the closed position or in the open position with the aid of an elastic element, in particular a spring.

8. The dot matrix printer according to claim 1 wherein at least one transport element for transporting the printing material in a feed direction is arranged in the feed area.

9. The dot matrix printer according to claim 1 wherein an input unit arranged upstream of the feed area is provided via which input unit the printing material can be manually input into the dot matrix printer.

10. The dot matrix printer according to claim 1 wherein the gap is dimensioned such that a passbook can be transported therethrough as a printing material.

11. A dot matrix inter comprising:

a printing unit for printing a printing material to be printed, a feed area for feeding the printing material to the printing unit, wherein the feed area comprises a gap through which the printing material to be fed is transported.

the printing unit prints the printing material in a print mode, wherein, in a feed mode, the printing material can be fed from the feed area to the printing unit and the printing unit does not print the printing material, a closing unit which at least partially closes the gap in the print mode, wherein the closing unit is arranged in a closed .position in the print mode and in an open position in the feed mode; and wherein the printing unit comprises a print head and a further drive unit which for printing the printing material moves the print head transversely to the feed direction of the printing material, in that the print head is arranged in a resting position in the feed mode and outside this resting position in the print mode, in that the closing unit is coupled to the print head via a coupling mechanism, and in that this coupling mechanism automatically moves the closing unit from the open position into the closed position when moving the print head out of the resting position, and/or automatically moves the closing unit from the closed position into the open position when moving the print head into the resting position.

12. The dot matrix printer according to claim 11, wherein the print head is fixedly mounted on a carrier unit, in that the further drive unit moves this carrier unit, and in that the coupling mechanism connects this carrier unit to the closing unit.

* * * * *